US008207891B1

(12) United States Patent
Lam et al.

(10) Patent No.: US 8,207,891 B1
(45) Date of Patent: Jun. 26, 2012

(54) LIGHTWEIGHT, MAN-PORTABLE, WIDEBAND, PHASED ARRAY ISR SYSTEM

(75) Inventors: Lawrence K. Lam, San Jose, CA (US); James C. Beffa, Sunnyvale, CA (US); Hilary S. Lackritz, Sunnyvale, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 228 days.

(21) Appl. No.: 12/782,154

(22) Filed: May 18, 2010

Related U.S. Application Data

(60) Provisional application No. 61/180,109, filed on May 20, 2009.

(51) Int. Cl.
*H01Q 3/00* (2006.01)

(52) U.S. Cl. ..... 342/368

(58) Field of Classification Search ..... 342/368
See application file for complete search history.

(56) References Cited

U.S. PATENT DOCUMENTS 7,697,462 B1 * 4/2010 Dunn et al. ..... 370/278
7,720,577 B2 * 5/2010 Cheng et al. ..... 701/2
2008/0316678 A1 12/2008 Ehrenberg et al.

OTHER PUBLICATIONS

Gregorwich, W.; Lam, L.; Horn, S.; "A multilayer subarray for multibeam phased arrays"; IEEE; USA.

* cited by examiner

*Primary Examiner* — Harry Liu
(74) *Attorney, Agent, or Firm* — Fraser Clemens Martin & Miller LLC; J. Douglas Miller

(57) ABSTRACT

A man-portable phased array ISR system includes a multi-layer panel. A first panel layer includes a subarray layer having a plurality of sensors for detecting and receiving radiofrequency information. A second panel layer includes a digital data storage system to digitize, record and store the radiofrequency information. A third panel layer includes a command and communication link. A fourth panel layer includes a nanoparticle ultra-capacitor energy storage system adapted to provide power to the subarray, to the digital data storage system and to the command and communication link. The plurality of sensors may be receive-only sensors for radio-frequency data collection. The first panel layer may include integral beamforming systems having a predetermined frequency range for transmit an receive radar signal formation and data collection.

20 Claims, 2 Drawing Sheets

LIGHTWEIGHT, MAN-PORTABLE, WIDEBAND, PHASED ARRAY ISR SYSTEM

CROSS-REFERENCE TO RELATED APPLICATIONS

Figure 1:
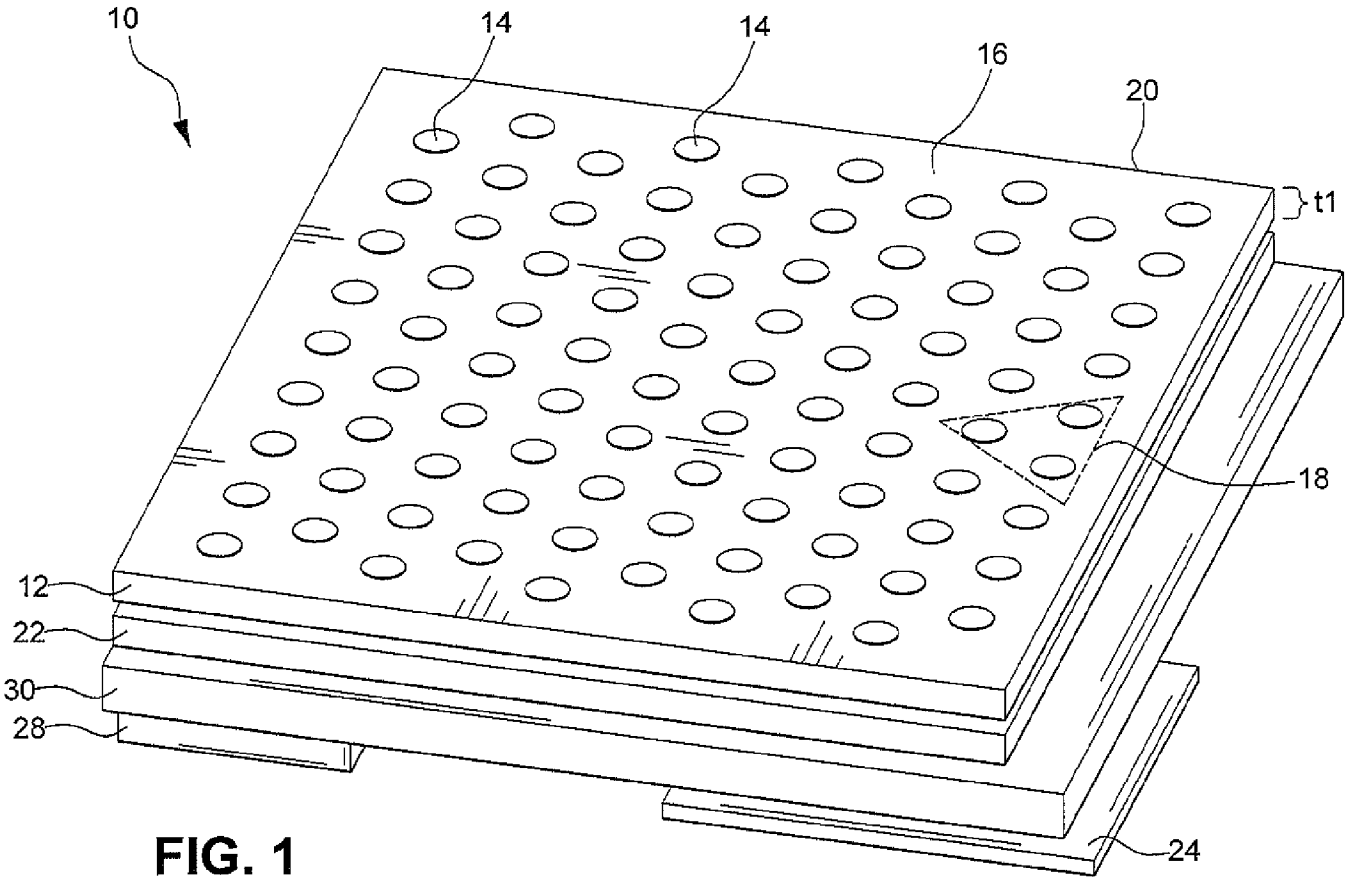

The present application claims priority to U.S. Provisional Patent Application Ser. No. 61/180,109 filed May 20, 2009, hereby incorporated herein by reference in its entirety.

STATEMENT REGARDING FEDERALLY SPONSORED RESEARCH OR DEVELOPMENT

Not applicable.

FIELD OF THE INVENTION

The invention relates generally to phased arrays, and more particularly to lightweight, man-portable, wideband phased array ISR systems.

BACKGROUND OF THE INVENTION

Successful missile defense systems require accurate observability of threats in flight. Additionally, the observability of threats in flight includes one or more of the steps of target acquisition, tracking, sensor fusion, discrimination, aim-point selection, and kill assessment. Threat observability typically depends on large, fixed phased array systems. However, the large, fixed phased array systems are expensive to implement and maintain, and failure of one system may lead to gaps in threat observability. Further, during military engagements, threat observability may be primarily a local phenomenon. Depending upon location, threat observability may not be available from a large, fixed phased array system.

Portable phased array intelligence, surveillance, and reconnaissance (ISR) collection systems have been implemented. However, "portable" phased arrays range in size from units weighing hundreds of pounds designed to be carried and set up by one or more persons to units weighing thousands of pounds designed to be integrally mounted only on mobile vehicles. Additionally, known portable phased array ISR systems require external power supplies such as generators, fuel cells, or the like, which are large and must be transported with the portable phased array ISR system. Known portable phased array ISR systems further include external command and control modules, often larger than the antenna array itself, that are interconnected to the ISR phased array antenna, either directly in substantially the same package as the array or via cables to remote locations.

Accordingly, there is a need for a phased array ISR system that is capable of being carried and deployed by a single individual that is self-contained, has a small form factor, and includes an integral beamforming system, integral command and control, and integral power storage and supply.

SUMMARY OF THE INVENTION

Concordant and consistent with the present invention, a lightweight, man-portable, wideband, phased array ISR system has surprisingly been discovered.

The phased array ISR system includes a multilayer panel. A first panel layer includes a subarray layer having a plurality of sensors for detecting and receiving radiofrequency information. A second panel layer includes a digital data storage system to digitize, record and store the radiofrequency information. A third panel layer includes a command and communication link. A fourth panel layer includes a nanoparticle ultra-capacitor energy storage system adapted to provide power to the subarray, to the digital data storage system and to the command and communication link. The plurality of sensors may be receive-only sensors for radio-frequency data collection. The first panel layer may include integral beamforming systems having a predetermined frequency range for transmit and receive radar signal formation and data collection.

In one embodiment, the phased array system includes fourth panel layer having a command and communication link for data transmission and remote system management. The command and communication link may be wireless or wired. The command and communication link may also be utilized to link two or more subarrays together to create diversity of orientation to develop more coverage, or to create a larger, more sensitive aperture, or to deliver more precise beam pointing in elevation or azimuth. A GPS locator may also be arranged as a fifth panel layer.

In another embodiment, the first layer may include integral beamforming systems for beam formation within one of an L-band, an S-band, a C-band, an X-band, a Ku-band, a K-band, or a Ka-band radar frequency range. In another embodiment, a fully functional bistatic active electronically scanned phased array system including digital data storage, an advanced power system and a GPS locator is integrated into a single subarray panel that has a thin profile and a scalable form factor.

DRAWINGS

The above, as well as other advantages of the present disclosure will become readily apparent to those skilled in the art from the following detailed description, particularly when considered in the light of the drawings described herein.

Figure 2:
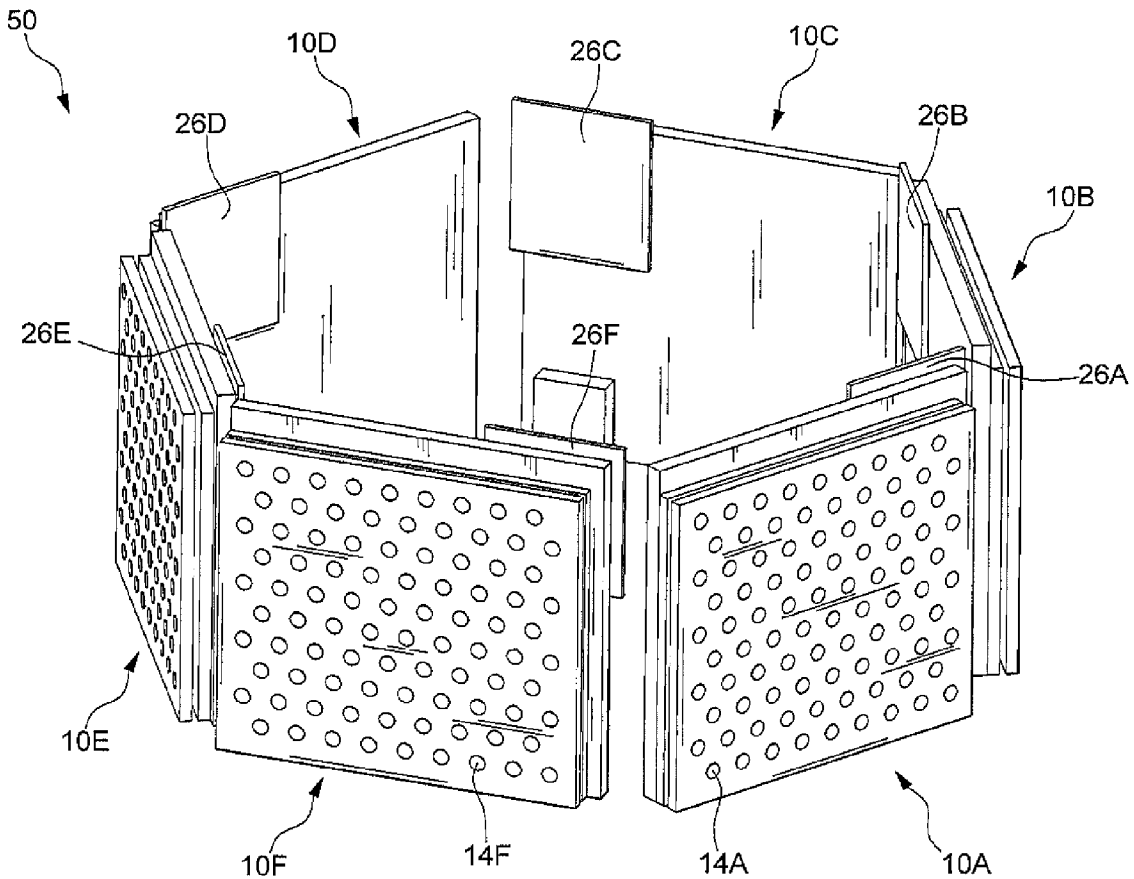

FIG. 1 is a schematic perspective view of an autonomous wideband ISR phased array system of the present invention; and FIG. 2 is a schematic perspective view of a plurality of subarrays deployed to form a larger aperture according to an embodiment of the invention.

DETAILED DESCRIPTION OF THE INVENTION

The following detailed description and appended drawings describe and illustrate various embodiments of the invention. The description and drawings serve to enable one skilled in the art to make and use the invention, and are not intended to limit the scope of the invention in any manner.

As shown in FIG. 1, an integrated phased array system 10 is constructed from multiple circuit boards arranged in layers. A subarray layer 12 is formed using known methods and commercial off the shelf components, including multilayer printed circuit board technology, advanced beamforming radiofrequency integrated circuitry, miniaturized filters, and field programmable gate array technology. The subarray layer 12 includes an array of antenna elements 14 arranged in a predetermined lattice structure on the outermost surface 16 of the subarray layer 12. The antenna elements 14 in FIG. 1 are shown as circular elements arranged in a triangular lattice structure 18 mounted on the surface 16 having a rectangular outer perimeter 20. It is understood, however, that the lattice structure and the shape of individual antenna elements may vary as desired. As non-limiting examples, the outer surface perimeter 20 may have a hexagon or octagon shape as desired.

The subarray layer 12 integrates all of the electrical circuits required to implement a fully functional active electronically scanned phased array into a single panel that has a thin profile and a predetermined form factor. The subarray layer 12 may be designed as a receive-only subarray to detect and acquire signals within a predetermined frequency band. The subarray layer 12 may also be designed to include a beamforming system within the desired frequency band to enable transmit and receive radar scanning and detection. Favorable results have been demonstrated wherein the subarray layer 12 operating within the S-band frequency range between 2.2 and 2.4 GHz has delivered a plurality of steerable beams with dual polarization for long range tracking of multiple targets, wherein the subarray thickness t1 is less than about 0.2 inches. Favorable results have also been demonstrated wherein the subarray layer 12 operating in the cell phone bands between 1992 to 2170 MHz in both transmit and receive mode has been constructed having a subarray thickness t1 of less than about 0.675 inches. Favorable results have also been demonstrated in the X-band frequency range between 8.0 and 12.0 GHz wherein the subarray layer 12 includes 256 dual polarization antenna elements 14 arranged in a triangular lattice structure having a thickness t1 less than about 0.5 inches. It is understood that the sublayer 12 may be constructed to operate in other radar frequency bands, including but not limited to L-band, C-band, Ku-band, K-band and Ka-band.

When used as either a receive-only antenna or as a transmit and receive antenna, the subarray 12 electronically scans in both azimuth and elevation across the predetermined frequency band, and acquires signals of interest. Once a signal is acquired, the subarray 12 locks onto the signal for data collection. The phased array system 10 tracks, digitizes, and records the signal of interest as signal digital data. The signal digital data is stored in a data storage layer 22 for later extraction, or it may be transmitted by a command and communication link layer 24. Both the data storage layer 22 and the command and communication link layer 24 may optionally have the same or smaller form factor as the subarray 12, defined by the shape of the perimeter 20 of the subarray layer 12.

The signal digital data derived from the receive signal may be transmitted in real time, or it may be temporarily stored and transmitted manually, upon command, or after a predetermined time delay. The digital storage layer 22 may include any known digital data storage method, including solid state storage and may also include any software instructions or programs required to control the system 10, including control of the antenna elements 14, the digital storage layer 22, and the command and communication link layer 24.

The command and communication link layer 24 may be controlled automatically through implementation of internal control software stored on the digital storage layer 22. Alternatively, the command and communication link layer 24 may be remotely controlled, and may include wireless data extraction, instruction delivery, and retrieval. The command and communication link layer 24 may also be adapted to transmit information on any suitable wiring, such as twisted pair or coaxial cable for example. No provision is made within the command and communication link layer 24 to analyze or process data beyond collection and storage thereof. Because the system does not include data processing or analysis, the power requirements of the system are minimized, while maximizing the data collection time.

Optionally, a GPS module 28 may be included within the system 10 to allow the system 10 to associate collected data with positional and temporal information for data fusion of multiple apertures. In this way, the location of the system 10, the relative location, or bearing of the tracked data and a time tag may be stored as system digital data available for extraction and later analysis.

Power is provided to the system 10, including to the subarray 12 and the data storage layer 22, by one or more energy storage layers 30 having substantially the same form factor as the subarray layer 12, defined by the shape of the perimeter 20 of the subarray layer 12. The energy storage layer 30 is formed as a nanoparticle ultra-capacitor as described in U.S. Patent Application Publication No. US2008/0316678, incorporated herein by reference in its entirety. The energy storage layer 30 has a higher storage density and lower weight than conventional lead acid batteries, and may include sublayers of multiple cells (not shown) electrically connected in parallel to form a cell pack arranged as the energy storage layer 30. As described in U.S. Patent Publication No. US2008/0316678, by electrically connecting the multiple cells in parallel, each cell provides a lower current with lower cell resistance, resulting in thinner cells having higher energy storage efficiency. Thinner cells reduce both weight and cost. Because of the lower power requirements of the system 10, in combination with the higher energy storage density of the energy storage layer 30, the system 10 is capable of data collection in either receive-only or transmit and receive modes of operation for extended periods of time.

Because the system 10 is manufactured in successive layers, each layer may be optimized for weight and performance for a given frequency band. When optimized for weight, the system 10 may be formed so that the entire system weight is less than about 75 pounds when the subarray layer 12 has a form factor of a square about one meter on each side and a thickness t1 of less than about one inch, making the system 10 capable of being carried and implemented by a single individual. Additionally, a single individual may transport and rapidly implement multiple systems as a larger array.

Because of the small size and weight of each system 10, multiple phased array systems 10 may be carried by a single vehicle and arranged by a single individual into a multiple aperture phased array system 50, shown in FIG. 2, where each system 10 is independently tasked for data collection. For example, as shown in FIG. 2, six phased array ISR systems 10A-10F are arranged in a hexagonal arrangement diversity of orientation to develop full azimuth coverage when each system 10A-10F is independently tasked. Alternatively, the multiple systems 10A-10F shown in FIG. 2 are scalable, and may be interconnected wirelessly or directly linked together through the command and communication link layer 26A-26F of each respective individual system 10A-10F. In particular, the command and communication link layer 26A-26F of each respective individual system 10A-10F is capable of interfacing and linking with one or more other systems. As a non-limiting example, the wireless command and communication link 26A of system 10A may interface and link with the command and communication link 26F of the system 10F to create a single aperture, wherein the sensors 14A and 14F are controlled together. In this way, by coupling multiple systems 10A-10F together, independently or dependently, larger phased array systems 50 may be designed and arranged to form larger phased array radar apertures, or may be arranged to provide diversity of orientation to develop more signal coverage over azimuth or elevation. Arranging multiple subarray systems 12 over a larger area or spatial distribution and with a diversity of orientation provides coordinated data collection, while larger aperture size allows for an improved sensor performance as measured by a ratio of antenna gain divided by the system temperature (higher G/T), leading to greater sensitivity for detecting and receiving weak or lowpower signals. Larger apertures also enable narrower steerable beams for special collection missions. As a result, the small, integrated phased array system 10 of the present disclosure may be easily tailored to fit many collection and monitoring missions. In particular, each system 10 may be tasked for individual data collection in one scenario, and also may be selectively linked to additional systems 10 to meet different collection scenarios. The system 10 therefore provides an extremely flexible data collection system capable of multiple configurations suitable for multiple different deployment scenarios.

Because each system is modular, integrated, and independently controllable, a single operator may deploy, command, and control a plurality of man-portable mobile antennas, each working either independently or in combination with one or more systems 10. Further, the control of each subarray 10 may be remote through a wireless or wired command and control communication module 26. Finally, the integral energy storage layer 30 ensures that power is available directly to the subarray 12 without significantly affecting the package size or weight.

While certain representative embodiments and details have been shown for purposes of illustrating the invention, it will be apparent to those skilled in the art that various changes may be made without departing from the scope of the disclosure, which is further described in the following appended claims.

What is claimed is:

1. A phased array ISR system, comprising:

a plurality of multilayer sensors forming a subarray arranged into a first panel layer, the sensors detecting and receiving information;

a digital data storage system arranged into a second panel layer, the digital data storage system recording and storing the information; and a nanoparticle ultra-capacitor energy storage system arranged into a third panel layer providing power to the subarray and the digital data storage system, wherein the first panel layer, the second panel layer and the third panel layer are stacked together to form a single multilayer panel.

2. The phased array ISR system of claim 1, further comprising a command and communication link arranged into a fourth panel layer in the single multilayer panel transmitting and receiving information.

3. The phased array ISR system of claim 2, further comprising a GPS locator arranged into a fifth panel layer in the single multilayer panel.

4. The phased array ISR system of claim 2, wherein the command and communication link transmits and receives information wirelessly.

5. The phased array ISR system of claim 2, wherein the command and communication link transmits the stored information.

6. The phased array ISR system of claim 4, wherein the command and communication link includes software instructions to control at least one of the sensors, the digital data storage system, and the command and communication link.

7. The phased array ISR system of claim 1, wherein the first panel layer includes an integral beamforming system for beam formation.

8. The phased array ISR system of claim 7, wherein the beamforming system operates within one of an L-band, an S-band, a C-band, an X-band, a Ku-band, a K-band, or a Ka-band radar frequency range.

9. The phased array ISR system of claim 1, wherein the multilayer panel is man-portable.

10. A man-portable phased array ISR system, comprising:

at least one multilayer panel, each panel comprising:

a first panel layer including a plurality of sensors forming a subarray, the sensors detecting and receiving information;

a second panel layer including a digital data storage system, the digital data storage system digitizing, recording and storing the information;

a third panel layer including a command and communication link; and a fourth panel layer including a nanoparticle ultra-capacitor energy storage system providing power to the subarray, the digital data storage system and the command and communication link.

11. The man-portable phased array ISR system of claim 10, further comprising a fifth panel layer including a GPS locator.

12. The man-portable phased array ISR system of claim 10, wherein the first panel layer includes an integral beamforming system for beam formation.

13. The man-portable phased array ISR system of claim 12, wherein the beamforming system operates within one of an L-band, an S-band, a C-band, an X-band, a Ku-band, a K-band, or a Ka-band radar frequency range.

14. The man-portable phased array ISR system of claim 13, wherein the command and communication link wirelessly interfaces and links with a second command and communication link of a second multilayer panel.

15. A man-portable phased array ISR system, comprising:

a first and a second multilayer panel, each panel comprising:

a first panel layer including a plurality of sensors forming a subarray, the sensors detecting and receiving information;

a second panel layer including a digital data storage system, the digital data storage system digitizing, recording and storing the information;

a third panel layer including a command and communication link; and a fourth panel layer including a nanoparticle ultra-capacitor energy storage system providing power to the subarray, the digital data storage system and the command and communication link, wherein the command and communication link of the first panel is wirelessly linked to the command and communication link of the second panel.

16. The man-portable phased array ISR system of claim 15, wherein the first multilayer panel and the second multilayer panel include a fifth panel layer including a GPS locator.

17. The man-portable phased array ISR system of claim 16, wherein the first panel layer of the first multilayer panel includes a first integral beamforming system for beam formation, and the first panel layer of the second multilayer panel includes a second integral beamforming system for beam formation.

18. The man-portable phased array ISR system of claim 17, wherein the first beamforming system and the second beamforming system operate within one of an L-band, an S-band, a C-band, an X-band, a Ku-band, a K-band, or a Ka-band radar frequency range.

19. The man portable phased array ISR system of claim 18, wherein the first multilayer panel and the second multilayer panel are independently tasked for coordinated data collection.

20. The man portable phased array ISR system of claim 18, wherein the first multilayer panel and the second multilayer panel are coordinated to provide a larger aperture size.

* * * * *